US008001797B2

(12) United States Patent
Tidrick

(10) Patent No.: US 8,001,797 B2
(45) Date of Patent: Aug. 23, 2011

(54) AIR CONDITIONER MONITOR AND ALARM SYSTEM

(76) Inventor: Thomas M. Tidrick, Fort Worth, TX (US)

( * ) Notice: Subject to any disclaimer, the term of this patent is extended or adjusted under 35 U.S.C. 154(b) by 858 days.

(21) Appl. No.: 11/903,881

(22) Filed: Sep. 25, 2007

(65) Prior Publication Data

US 2009/0077984 A1 Mar. 26, 2009

(51) Int. Cl.
*G01K 13/00* (2006.01)
*H01H 47/12* (2006.01)
*G05D 23/00* (2006.01)

(52) U.S. Cl. ..... 62/129; 165/11.1; 236/94; 361/178

(58) Field of Classification Search ..... 62/125, 62/126, 127, 129, 228.3; 165/11.1; 236/94; 361/22, 178

See application file for complete search history.

(56) References Cited

U.S. PATENT DOCUMENTS

| | | | | |
|---|---|---|---|---|
| 3,778,634 | A * | 12/1973 | Hanrihan | 307/64 |
| 4,038,061 | A | 7/1977 | Anderson et al. | |
| 5,444,436 | A * | 8/1995 | Kennison | 340/635 |
| 6,184,641 | B1 * | 2/2001 | Crimmins et al. | 318/466 |
| 7,234,313 | B2 | 6/2007 | Bell et al. | |
| 2006/0032245 | A1 * | 2/2006 | Kates | 62/129 |

* cited by examiner

*Primary Examiner* — Frantz F Jules
*Assistant Examiner* — Daniel C Comings
(74) *Attorney, Agent, or Firm* — Lynn E. Barber

(57) ABSTRACT

A monitor system for an air conditioning unit having a suction refrigerant line and a liquid refrigerant line. The monitor system has two low pressure sensors mounted on the suction refrigerant line; a high pressure sensor mounted on the liquid refrigerant line; a back-up battery; an AC transformer; an AC to DC converter board having three connection points; two double DPDT relays; a terminal board having terminals for connection to the converter board, the relays, a warning device and the pressure sensors. For commercial size air conditioning systems, the monitor system has two 12-volt back-up batteries; two AC transformers; two 16 AC to DC converter boards, and three double DPDT relays.

11 Claims, 3 Drawing Sheets

AIR CONDITIONER MONITOR AND ALARM SYSTEM

BACKGROUND OF THE INVENTION

1. Field of the Invention

This invention relates to air conditioners, and in particular, relates to a monitor and alarm system for air conditioners.

2. Description of the Related Art

Air conditioners are increasingly an essential part of office buildings and residences, particularly in southern climates. Central air conditioners typically include an outdoor condensing unit including a refrigerant compressor, an indoor evaporator unit, and a manually adjustable indoor thermostat responsive to the indoor temperature for selecting and controlling the operation of the air conditioner.

Air conditioning systems use a thermally conductive coolant such as freon in a conduit. Heat exchange systems transfer heat from inside the conduit to the outside of the conduit. In an expansion valve, the high pressure, low temperature coolant is reduced in pressure, which lowers the temperature of the coolant. The coolant then is transferred into a series of coiled tubes that act as a heat exchanger with warm air from the building, thus cooling the warm air which when cooled is circulated through the structure.

The efficient functioning of air conditioners require that there be sufficient coolant in the conduit, that the coolant be cooled, that power to the system is sufficient to operate the air conditioner, that the components of the air conditioner be present and operating. Diagnosing problems when air conditioners do not function properly, or at all, generally requires a service technician, since a typical building owner or tenant is not usually trained or knowledgeable in such matters.

Thus, there is a need for an air conditioner monitor that monitors the unit to determine if refrigerant pressure is too high or too low, to determine if the fan motor has gone out, to determine if there is a leak or if someone is attempting to steal components of the air conditioner such as the copper coils, and the like. The latter problem has become increasingly common as copper has become more valuable as a commodity. There is also a need to have a monitor that functions even if the power to the monitor has been cut, such as might occur in a theft.

There are previous systems that accomplish some of these goals. For example, some air conditioners already have a thermostat with monitors, and a computer to monitor sensors, but there is no alarm.

The patent of Anderson et al. (U.S. Pat. No. 4,038,061) has a control system for protecting an air conditioner and a malfunction indicator. The control system keeps the air conditioner from being turned on in the event of low power, and has a current sensing control.

U.S. Pat. No. 7,234,313 of Bell et al. provides a monitor and superheat calculator system for air conditioners, which has a handheld monitoring device and a remote sensing unit for temperature and pressure which is placed within the return air flow of the A/C system. Additional sensors may be provided with communication between the sensors. Data from these sensors allow a technician to diagnose A/C problems.

The furnace and air conditioner failure alarm of Kennison (U.S. Pat. No. 5,444,436) provides a battery power supply to power circuits in case of A/C power failure. An environmental temperature sensor monitors the area being air conditioned and is connected to alarm circuitry which is activated when the temperature is at an unacceptable level.

It is therefore an object of this invention to monitor the low and high pressure on air conditioning units to warn the owner of problems that need repair by an air conditioning technician, thus preventing extensive damage, and to avert theft of the air conditioning unit or the coils. Thus the invention is designed to allow easier determination of whether there is a problem with an A/C unit and of what the possible problem and its cause might be, particularly if the problem is important to the function of the air conditioning system.

It is a further object of the invention to provide a monitor and alarm that includes one or more visual or audible alarms when the monitor registers problems.

Other objects and advantages will be more fully apparent from the following disclosure and appended claims.

SUMMARY OF THE INVENTION

The invention herein is a monitor and alarm system for an air conditioning unit having a suction (low pressure) refrigerant line and a liquid (high pressure) refrigerant line.

The monitor system in a first embodiment primarily for residential customers monitors low and high pressure and indicates problems that occur, such as low refrigerant, dirty coils, dirty filter, or either of the fan motors has gone out. It has two low pressure sensors mounted on the suction refrigerant line; a high pressure sensor mounted on the liquid refrigerant line; a back-up battery; an AC transformer; an AC to DC converter board having three connection points; two double DPDT relays (one side of relay may be connected with house security system); a terminal board having terminals for connection to the converter board, the relays, a warning device and the pressure sensors. The term "converter board" herein includes power supplies as known in the art.

The second embodiment has another back-up battery; a larger terminal board; two 110 V AC to 16 V AC transformers; and two converter boards. One converter board controls monitoring of the air conditioning system, and the other controls warning devices (may be connected with security system) and will automatically activate alarms if the first is disconnected or loses DC power. Preferably this embodiment provides a warning sound and/or light signal if someone tries to steal the unit or its coils or the A/C unit loses extensive pressure for another reason. There is a battery back-up for loss of A/C power.

Other objects and features of the inventions will be more fully apparent from the following disclosure and appended claims.

DETAILED DESCRIPTION OF THE INVENTION AND PREFERRED EMBODIMENTS THEREOF

The present invention is a monitor and alarm for an air conditioner that has an outdoor condensing unit including a refrigerant compressor, an indoor evaporator unit, and a manually adjustable indoor thermostat responsive to the indoor temperature for selecting and controlling the operation of the air conditioner. The air conditioner monitor of the invention works with any air conditioner, with adjustments of sensors as known in the art depending on the particular coolant used.

There are two embodiments of the invention, both of which monitor the high and low pressure of the air conditioning units to warn the owner of problems that need repair by an air conditioning technician so that extensive damage is prevented and to give advanced warning of problems with the cooling side of an air conditioning system. The second embodiment also enables the owner to avert theft of the unit or coils, by including isolation type relays to prevent a would-be thief from shorting one system in order to avoid setting off alarms.

As used herein the general terms "warning device" and "alarm" are used interchangeably unless otherwise specified. Such alarms include sound producing devices such as sirens and chirping sounds, and others known in the art, and light-producing devices such as flood lights and flashing lights and others known in the art, or combination light- and sound-producing devices.

The first embodiment 10 air conditioner monitor system of the invention is particularly appropriate for central air conditioners for residences or other small building spaces, while the second embodiment 20 is particularly appropriate for central air conditioning systems in office buildings, hospitals, schools and other large building spaces that have multiple, large air conditioning units.

Figure 1:
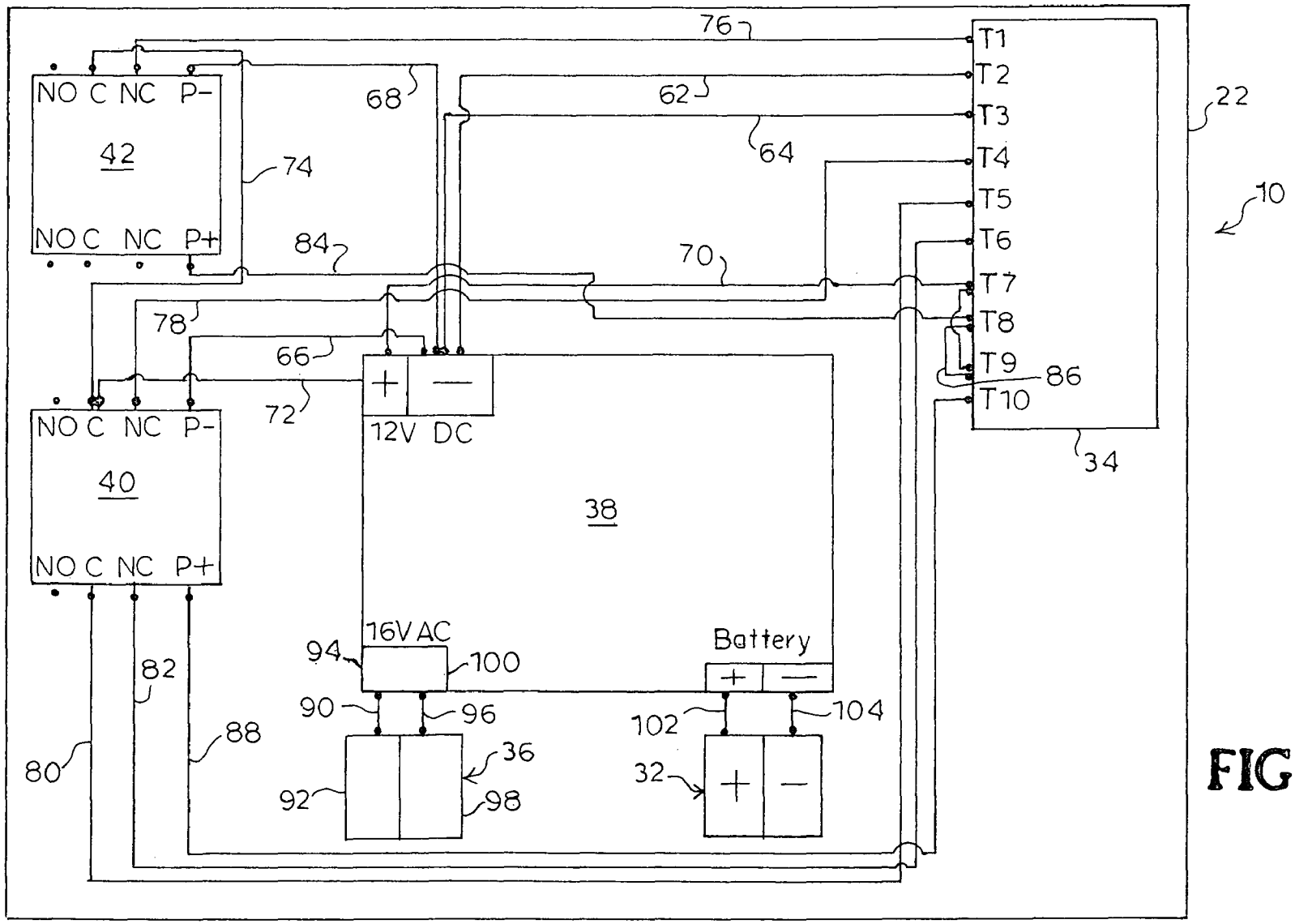
FIG. 1 is a schematic diagram of the first embodiment of the monitor and alarm system of the invention for use in smaller buildings such as residences, or other small buildings

Referring in greater detail to the figure, as shown in FIG. 1, the components, discussed below, of both embodiments of the invention are preferably enclosed in a lockable sturdy box, such as a metal enclosure 22. While it is preferred that this metal enclosure relatively closely surround the main components of the invention as discussed below, and that the enclosure be sufficiently ventilated to avoid overheating problems, it some instances the enclosure may comprise a small room or other preferably lockable, ventilated space. The location of the components within the enclosure 22 may be as shown in the figures or as may be varied by the manufacturer as known in the art, so long as the various components function for their intended purpose.

Figure 2:
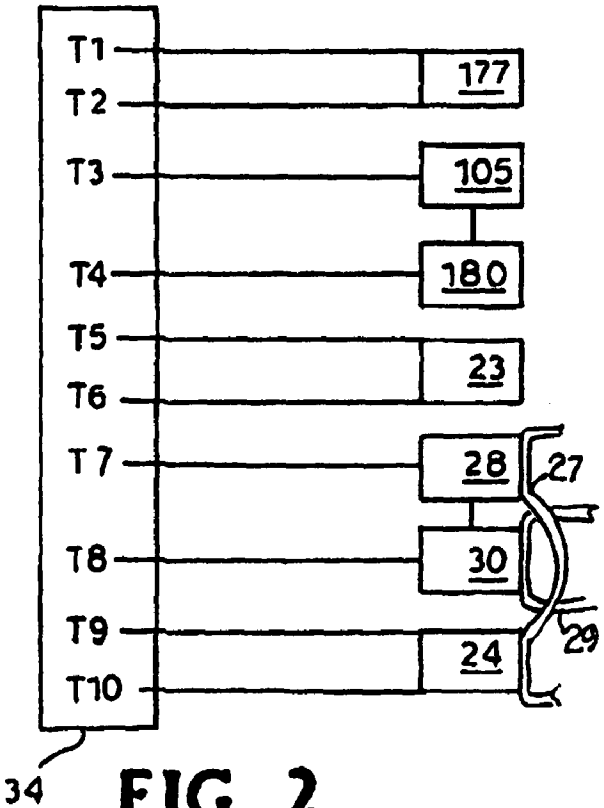
FIG. 2 is a schematic diagram showing the terminal board in the first embodiment shown in FIG. 1, and its connections to selected components of the monitory and alarm system and of the building in which the system is installed

In the first embodiment 10 of the invention herein (FIGS. 1-2), the complete air conditioner monitor system includes the following components in addition to the enclosure 22: one low pressure sensor 24 to be mounted on the suction refrigerant line 27 to monitor the refrigerant pressure; one mid/low pressure sensor 28 to be mounted on the suction refrigerant line 27; one high pressure sensor 30 on the liquid refrigerant line 29 of the air conditioner, one 12-volt A/C back-up battery 32 (maximum 40 Ah); one 10-connector terminal board 34; one 110 V AC to 16 V AC transformer 36; one 16 V AC to 12 V DC power supply (called converter board 38 herein (5 amp)) with three connection points (12 V DC positive and negative; 16 V AC-2 terminals; and battery terminal positive and negative); two double DPDT relays 40, 42 with 12 V DC control coil (not shown; this is part of the A/C system); 50 feet of 18 gauge electrical wire; 20¼-inch female spade terminal ends which are placed at the ends of the wires as known in the art, and are not shown; and eight ½-inch nylon standoff pieces, which are placed between components and the enclosure 22 and the like as known in the art. The number of feet of electrical wire may be varied depending on the number and location of air conditioning units being monitored. While two DPDT relays are most preferred, it is possible that a single relay would be acceptable for some uses, even though the functionality of the system would be decreased by decreasing the on/off capability.

The pressure sensors will change with the air conditioner system requirements (e.g. R-22, R-410A, etc.) and should be mounted on the refrigerant lines by a certified technician as known in the art.

The second embodiment 20 of the invention contains the same components as the first embodiment, with the following preferred modifications thereof for monitoring of the typically larger and more expensive air conditioning units used in commercial buildings. In the second embodiment, the preferred lockable sturdy enclosure 22 is a steel vented enclosure cabinet. In the second embodiment there is a second 12-volt A/C back-up battery 44 (maximum 40 Ah); a 12-connector terminal board 46; two 110 V AC to 16 V AC transformers 48, 50; two 16 V AC to 12 V DC power supplies (converter board 52 being 5 amp for alarm connection and converter board 54 being 2 amp for monitoring) with three connection points; three double DPDT relays 56, 58, 60 with 12 V DC control coil; 80 feet of 18 gauge electrical wire; 25¼-inch female spade terminal ends; and 16½-inch nylon standoff pieces. Because the 5 amp converter board 52 is vulnerable with the wires going outside box 22, if something happens to it, the alarms connected to the 2 amp board 54, which is not vulnerable because the relays are opened due to loss of the 5 amp board, causing the 2 amp board to set off alarms. This arrangement allows grouping of five air conditioners in a monitoring and alarm system.

The number and specifications for each of the components used in the invention may be varied by one of skill in the art depending on the particular air conditioner(s) being monitored without departing from the invention herein. The number of feet of electrical wire may be varied depending on the number and location of air conditioning units being monitored.

There are two transformers and back-up batteries so if someone shorts out the operating electrical components, there is a back-up that will set off the alarm(s) in the system of the invention It is to be noted that the sizes of converter boards, transformers, and relays can and will be changed with respect to a particular system's needs. Similarly, pressure sensors can and will be changed in accordance with the refrigerant used in the air conditioning system, as is known in the art.

FIG. 1 shows the components of the first embodiment 10 of the invention as mounted in the enclosure or as attached to components mounted in the enclosure 22. In the preferred method of assembly of the first embodiment 10, the components are placed in the enclosure as follows: mount transformer 36 in the enclosure 22; mount the converter board 38 in the enclosure 22 using ½-inch nylon standoffs to prevent the converter board 38 from coming in contact with the metal enclosure 22; mount two DPDT relays 40, 42 in the enclosure using ½-inch nylon standoffs to prevent the relays from coming in contact with the metal enclosure 22; and mount the terminal board 34 in the enclosure 22; and place the back-up battery 32 in the enclosure 22.

The components are then wired as following with T1-T10 referring to terminals on terminal board 34:

a) attach wire 62 from converter board 38, 12 V DC negative to terminal T2 on the terminal board 34;

b) attach wire 64 from converter board 38, 12 V DC negative to terminal T3 on the terminal board 34;

c) attach wire 66 from converter board 38, 12 V DC negative to relay 40 at P-negative;

d) attach wire 68 from converter board 38, 12 V DC negative to relay 42 at P-negative;
e) attach wire 70 from converter board 38, 12 V DC positive to terminal board 34 T7;
f) attach wire 72 from converter board 38, 12 V DC positive to relay 40, side B, common terminal
g) attach wire 74 from relay 40, side B, common terminal to relay 42, side B, common terminal;
h) attach wire 76 from terminal T1 on terminal board 34 to relay 42, side B, at normally closed terminal;
i) attach wire 78 from terminal T4 to relay 40, side B, at normally closed terminal;
j) attach wire 80 from terminal T5 to relay 40, side A, at common terminal;
k) attach wire 82 from terminal T6 to relay 40, side A, at normally closed terminal;
l) attach wire 84 from terminal T8 to relay 42 at P-positive terminal;
m) attach wire 86 from terminal T9 to terminal T8 on terminal board 34;
n) attach wire 88 from terminal T10 to relay 40 at P-positive terminal;
o) attach wire 90 from a first side 92 of transformer 36 to a first side 94 of converter board 38 16 V AC;
p) attach wire 96 from a second side 98 of transformer 36 to a second side 100 of converter board 38 at 16 V AC;
q) attach wire 102 from back-up battery 32, positive post, to converter board 38, battery terminal positive; and
r) attach wire 104 from back-up battery 32, negative post, to converter board 38, battery terminal negative.

Figure 4:
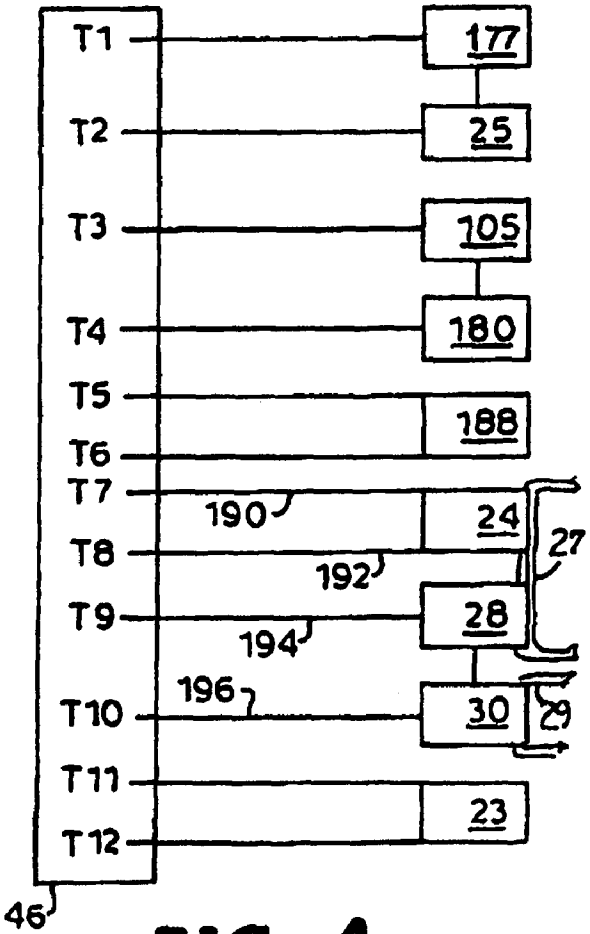
FIG. 4 is a schematic diagram showing the terminal board in the second embodiment shown in FIG. 1, and its connections to selected components of the monitory and alarm system and of the building in which the system is installed.

Thus in the arrangement of the terminal board 34 of the first embodiment 10 as shown herein (FIG. 2), T1 and T2 are connected to a warning light 177 to signal the need for an air conditioning technician. As shown in FIG. 4 for the second embodiment, in the first embodiment T3 and T4 can optionally be attached to a keypad device 105 through a chirper/light device 180 or the like to be mounted in a conspicuous place. The keypad device 105, which the owner or technician can use to enter a code to turn off the alarms is essentially a switch, which may have a keypad to restrict the ability to turn the invention on and off. Optionally the terminal board may be attached to other components, for example, a door lock mechanism.

T3 and T4 are optionally connected to a siren/strobe alarm type device 180 (or other warning device) back into T4 (optionally with a keypad 105 (or switch or lockswitch) as shown). T5 and T6 are available to attach to a house security system 23 to be installed by the security system company with the wire attached from T5 through the security system and back into T6. T7 is connected to the mid/low refrigerant pressure sensor 28 on the suction side of the air conditioning unit. On the opposite side of the mid/low pressure sensor a wire is attached to a high pressure sensor 30 mounted on the liquid line of the air conditioning unit. T8 is attached to the high pressure sensor 30. T9 and T10 are attached to the low pressure sensor 24 mounted on the suction line of the air conditioning unit for theft protection. When the pressure is very low or zero, one or more warning devices of the system of the invention are caused to be activated by means known in the art.

Other arrangements of the terminal board are of course possible as known in the art.

Figure 3:
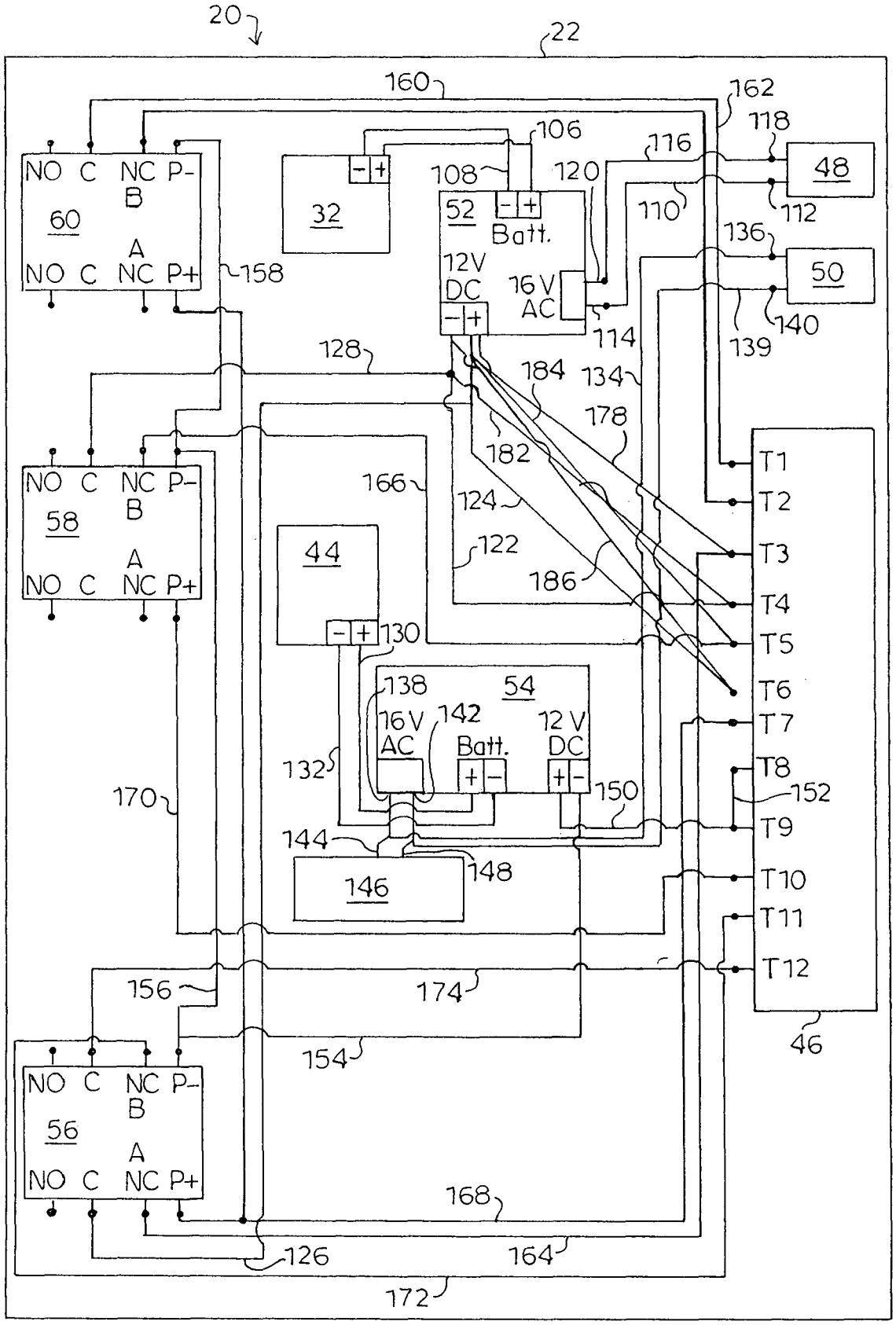
FIG. 3 is a schematic diagram of the second embodiment of the monitor and alarm system of the invention for use in larger buildings such as commercial buildings having multiple, large air conditioning systems.

FIG. 3 shows the components of the second embodiment 20 of the invention as mounted in the enclosure 22 or attached to components mounted in the enclosure 22. As in the first embodiment, in the preferred method of assembly of the second embodiment, the components are placed in the enclosure as discussed above with respect to the transformers 48, 50, converter boards 52, 54, relays 56, 58, 60 and terminal board 46.

Then attach wire 106 from back-up battery 32, positive post, to converter board-52, battery terminal positive; attach wire 108 from back-up battery 32, negative post, to converter board 52, battery terminal negative; attach wire 110 from a first side 112 of transformer 48 to a first side 114 of converter board 52 at 16 V AC; and attach wire 116 from a second side 118 of transformer 48 to a second side 120 of converter board 52 at 16 V AC.

The remaining components are then wired as follows with T1-T12 referring to terminals on terminal board 46:

a) attach wire 122 from converter board 52, 12 V DC negative to terminal T4;
b) attach wire 124 from converter board 52, 12 V DC negative to terminal T6;
c) attach wire 126 from converter board 52, 12 V DC positive to relay 56, side A, at common terminal;
d) attach wire 128 from converter board 52, 12 V DC positive to relay 58, side B, at common terminal;
e) attach wire 130 from converter board 54, positive battery terminal, to back-up battery 44, positive post;
f) attach wire 132 from converter board 54, negative battery terminal, to back-up battery 44, positive post;
g) attach wire 134 from first side 136 of transformer 50 to a first side 138 of converter board 54 at 16 V AC;
h) attach wire 139 from second side 140 of transformer 50 to second side 142 of converter board 54 at 16 V AC;
i) attach wire 144 from a/c power light 146 to first side 138 of converter board 54 at 16 V AC;
j) attach wire 148 from a/c power light 146 to second side 142 of converter board 54 at 16 V AC;
k) attach wire 150 from converter board 54, 12 V DC positive to T9;
l) attach wire 152 from T9 to T8;
m) attach wire 154 from converter board 54, 12 V DC negative to relay 56 at P-negative terminal;
n) attach wire 156 from relay 56 at P-negative terminal to relay 58 at P-negative terminal;
o) attach wire 158 from relay 58 at P-negative terminal to relay 60 at P-negative terminal;
p) attach wire 160 from T1 to relay 60, side B, at common terminal;
q) attach wire 162 from T2 to relay 60, side B, at normally closed terminal;
r) attach wire 164 from T3 relay 56, side A, at normally closed terminal;
s) attach wire 166 from T5 to relay 58, side B, at normally closed terminal;
t) attach wire 168 from T7 to relay 56 at P-positive terminal and jumper 169 to relay 60 at P-positive terminal;
u) attach wire 170 from T10 to relay 58 at P-positive terminal;
v) attach wire 172 from T11 to relay 56, side B, at normally closed terminal;
w) attach wire 174 from T12 to relay 56, side B, at common terminal (maximum 10 amps);
x) T1 and T2 may have one side of 110 V AC run through them to operate flood lights 177 by running a 110 volt leg 176 in on T2 and back out at T1 (as is shown on FIG. 2 for the first embodiment;
y) attach wire 178 from T3 to converter board 52, 12 V DC positive, to connect strobe/siren alarm type device 180;
z) attach wire 182 from T4 to converter board 52, 12 V DC negative, to connect alarm type device 180 aa) attach wire 184 from T5 to converter board 52, 12 V DC positive, to connect light/chirper warning type device 188;

bb) attach wire 186 from T6 to converter board 52, 12 V DC negative, to connect light/chirper warning type device 188;

cc) attach wire 190 from T7 to negative side of low pressure sensor 24 mounted on the air conditioning unit (not shown) to monitor refrigerant pressure;

dd) attach wire 192 from T8 to positive side of low pressure sensor 24;

ee) attach wire 194 from T9 to positive side of mid/low pressure sensor 28, mounted on air conditioning unit to monitor refrigerant pressure;

ff) attach wire 196 from T10 to negative side of mid/low pressure sensor 28.

T11 and T12 are made accessible for optional monitoring by the building security system 23 as shown in FIG. 4.

Thus in the arrangement of the terminal board 46 of the second embodiment 20 as shown herein (FIG. 4), T1 and T2 are connected to a warning light 177 to signal the need for an air conditioning technician, and to house breaker box 25. T3 and T4 are optionally attached to a keypad device 105 through a chirper/light device 180 or the like to be mounted in a conspicuous place. T5 and T6 are available to attach to a warning light 188. T7 and T8 are connected to the low pressure sensor 24 on the suction side of the air conditioning unit. T9 and T10 are attached to the mid/low pressure sensor 28 and a high pressure sensor 30 mounted on the liquid line of the air conditioning unit. Optionally, but not shown herein, a high temperature sensor and a low temperature sensor may be added to the system as known in the art. T11 and T12 are attached to house security system 23.

Other arrangements of the terminal board of the second embodiment are of course possible as known in the art and as may be fashioned for particular types of warning and monitoring devices as well as for particular A/C systems.

It is clear that one of ordinary skill in the art can vary the wiring in the invention embodiments herein, for example, which terminal is used for a particular component, and other standard variations and combinations as known in the art.

While the invention herein is designed for use with air conditioners, the invention may be modified as known by one of ordinary skill in the art for use with other pressure systems, for example air compressors, or for systems that are intended to remain at low pressure.

While the invention has been described with reference to specific embodiments, it will be appreciated that numerous variations, modifications, and embodiments are possible, and accordingly, all such variations, modifications, and embodiments are to be regarded as being within the spirit and scope of the invention.

What is claimed is:

1. A monitor and alarm system for an air conditioning unit having a suction refrigerant line and a liquid refrigerant line, comprising:

a) a low pressure sensor mounted on the suction refrigerant line;

b) a mid/low pressure sensor mounted on the suction refrigerant line;

c) a high pressure sensor mounted on the liquid refrigerant line;

d) a 12-volt back-up battery;

e) a 110 V AC to 16 V AC transformer;

f) a 16 V AC to 12 V DC converter board having three connection points;

g) a double pole double throw (DPDT) relay;

h) a terminal board having a plurality of terminals for connection to the converter board and the relay, and to a warning device and to the pressure sensors on the suction and liquid refrigerant lines; and i) wherein the back-up battery, transformer, converter board, relays and terminal board are located within an enclosure, and wherein the monitor and alarm system monitors high and low pressure of the air conditioning unit and sets off the warning device to warn of pressure problems of the air conditioning unit.

2. The monitor and alarm system of claim 1, wherein there are two DPDT relays.

3. The monitor and alarm system of claim 1, wherein the enclosure is a metal enclosure.

4. The monitor and alarm system of claim 2, wherein the terminal board has ten terminals.

5. The monitor and alarm system of claim 2, wherein the warning device is selected from the group consisting of: warning lights, chirper/light devices and siren/strobe light devices.

6. The monitor system and alarm of claim 2, wherein the three connection points of the converter board are a) 12 V DC positive and negative; b) 16 V AC-2 terminals; and c) battery terminal positive and negative.

7. The monitor and alarm system of claim 1, wherein the monitor system comprises two back-up batteries, and two 110 V AC to 16 V AC transformers; two 16 V AC to 12 V DC converter boards each having three connection points; and three DPDT relays.

8. The monitor and alarm system of claim 7, wherein the terminal board has twelve terminals.

9. The monitor and alarm system of claim 7, wherein the warning device is selected from the group consisting of: warning lights, chirper/light devices and siren/strobe light devices.

10. The monitor system and alarm of claim 7, wherein the three connection points of the converter board are a) 12 V DC positive and negative; b) 16 V AC-2 terminals; and c) battery terminal positive and negative.

11. A monitor and alarm system for an air conditioning unit having a suction refrigerant line and a liquid refrigerant line, comprising:

a) a low pressure sensor mounted on the suction refrigerant line;

b) a mid/low pressure sensor mounted on the suction refrigerant line;

c) a high pressure sensor mounted on the liquid refrigerant line;

d) two 12-volt back-up batteries;

e) two 110 V AC to 16 V AC transformers;

f) two 16 V AC to 12 V DC converter boards, each converter board having three connection points;

g) three DPDT relays;

h) a terminal board having a plurality of terminals for connection to the converter board and the relays, and to a warning device and to the pressure sensors on the suction and liquid refrigerant lines; and i) wherein the back-up batteries, transformers, converter boards, relays and terminal board are located within an enclosure, and wherein the monitor and alarm system monitors high and low pressure of the air conditioning unit and sets off the warning device to warn of pressure problems of the air conditioning unit.

* * * * *